US007146896B2

(12) United States Patent
Chang

(10) Patent No.: US 7,146,896 B2
(45) Date of Patent: Dec. 12, 2006

(54) LEMON-WEDGE CUTTER FOR RESTAURANTS AND BARS

(76) Inventor: Ching T. Chang, 1074 E. Walnut St., Westerville, OH (US) 43081

( * ) Notice: Subject to any disclaimer, the term of this patent is extended or adjusted under 35 U.S.C. 154(b) by 314 days.

(21) Appl. No.: 10/824,314

(22) Filed: Apr. 14, 2004

(65) Prior Publication Data

US 2005/0229760 A1 Oct. 20, 2005

(51) Int. Cl.
*B26D 3/26* (2006.01)

(52) U.S. Cl. ..... 83/865; 83/874; 83/602; 83/629; 83/932; 99/537

(58) Field of Classification Search ..... 83/932, 83/629, 874, 602, 862, 865; 99/537, 538
See application file for complete search history.

(56) References Cited

U.S. PATENT DOCUMENTS 2,247,650 A * 7/1941 Carlson ..... 83/435.18
2,321,725 A 6/1943 Alderfer
3,818,788 A * 6/1974 Vadas ..... 83/872
3,830,151 A 8/1974 Gerson
4,095,518 A 6/1978 Jones
4,129,068 A * 12/1978 McKenzie ..... 99/538
4,320,680 A * 3/1982 de la Cruz et al. ..... 83/870
4,959,903 A 10/1990 Daoust
5,337,480 A * 8/1994 Codikow ..... 30/114
5,445,068 A * 8/1995 Michelson ..... 99/504
5,452,514 A 9/1995 Enfaradi
5,937,525 A 8/1999 Chan
6,243,952 B1 6/2001 Holcomb
6,718,868 B1 * 4/2004 Ismail et al. ..... 99/584

OTHER PUBLICATIONS

Product picture, Mighty OJ Citrus Juicer, Metrokane, Inc.

* cited by examiner

*Primary Examiner*—Kenneth E. Peterson

(57) ABSTRACT

A cutting device hygienically cuts a lemon into wedges with a crosscut for hanging the wedges on glasses as served with beverages, such as ice-tea, or cocktails in restaurants or bars. Simple mechanism: the cam mechanism and the gear-rack assembly are driven by two separate manually operated handles that attach to the machine to achieve the slicing actions. Cutting a lemon into wedges with crosscuts is accomplished by simply placing the lemon into the center of the machine and adding pressure in sequence to the two handles by the operator.

7 Claims, 8 Drawing Sheets

LEMON-WEDGE CUTTER FOR RESTAURANTS AND BARS

CROSS-REFERENCES

None.

FIELD OF THE INVENTION

The present invention provides manual-operating equipment generally related to the food and beverage industry to prepare citrus fruit garnishes for beverages with the advantages of safety, hygiene, and labor-efficiency.

BACKGROUND OF THE INVENTION

Hand-cutting of beverage garnishes, especially, the hand-cutting of lemon-wedges has been practiced in restaurants and bars for many years with the concern of hand contamination and the cost of time and labor for considerable quantities demanded daily.

Numerous patents disclose devices for cutting citrus fruits into segments. For example, U.S. Pat. No. 6,243,952 illustrates a triangular cutting blade, controlled by a pinion gear and racks mechanism assembled in the cutter handle, to remove a segment or segments from citrus fruit. U.S. Pat. No. 4,959,903 describes a citrus fruit pulp cutter having a number of spaced arcuate knives to segment and remove the pulp from a half-section of a citrus fruit. U.S. Pat. No. 2,321,725 illustrates a segment-cutting blade that is a piece of bent flat metal wire formed with a cutting edge to separate the pulp from the rind of a citrus fruit.

U.S. Pat. No. 5,452,514 illustrates a fruit cutting apparatus including a two-part blade with a handle to penetrate a citrus fruit and leave a crosscut inside of the fruit, but not cutting the fruit into wedges. U.S. Pat. No. 4,095,518 and U.S. Pat. No. 3,830,151 illustrate a method of cutting a fruit into wedges. Yet neither of these two devices are capable of a cutting a fruit into wedges with crosscuts. Therefore, no prior device cuts a citrus fruit into wedges leaving a crosscut on each, all the above mentioned devices would have limited functions and capabilities.

Accordingly it is the primary object of the present invention to provide a manual operated lemon-wedge cutting machine for the food and beverage industry to solve the existing problems and significantly improve the quality of the beverage garnish. Other citrus fruits such as limes and oranges can also be cut by the same machine.

SUMMARY OF THE INVENTION

The lemon-wedge cutter of the present invention is basically comprised of a lemon auto-center mechanism having three spring-loaded center adjusters mounted around an open center of a cylinder shaped inner-housing that is sitting on the upper part of a deeper cylinder shaped outer housing that is mounted on a horseshoe shaped base of the invented cutter. A two-dimensional cam, controlled by a handle, drives a sliding and waving knife which is pivotally mounted on a slider assembled with a pair of linear guides in the inner-housing of the invented cutter, a gear-rack mechanism with a vertical-moving guide-rod and a press cylinder mounted on a single plate which can be moved up and down controlled by the gear handle on the side of the outer housing, and a wedge-cutting knife mounted on the bottom inside of the outer housing. An open-center cover mounts on the top of the machine housing.

After a lemon is placed in the central hole of the cutter, pressure added to the cam handle in front of the cutter turns the two-dimensional cam to drive the sliding knife penetrating the lemon over its center and waving the blade horizontally to make a crosscut inside of the lemon. The cam then returns to its original position automatically by the force of an attached torsion spring when the operation pressure is discharged from the cam handle. By adding pressure on the other handle located on the side of the cutter, the gear-rack mechanism turns to push the lemon down by the press cylinder through the wedge-cutting knife and drops the lemon in wedges with crosscuts.

DETAIL DESCRIPTION

Figure 1:
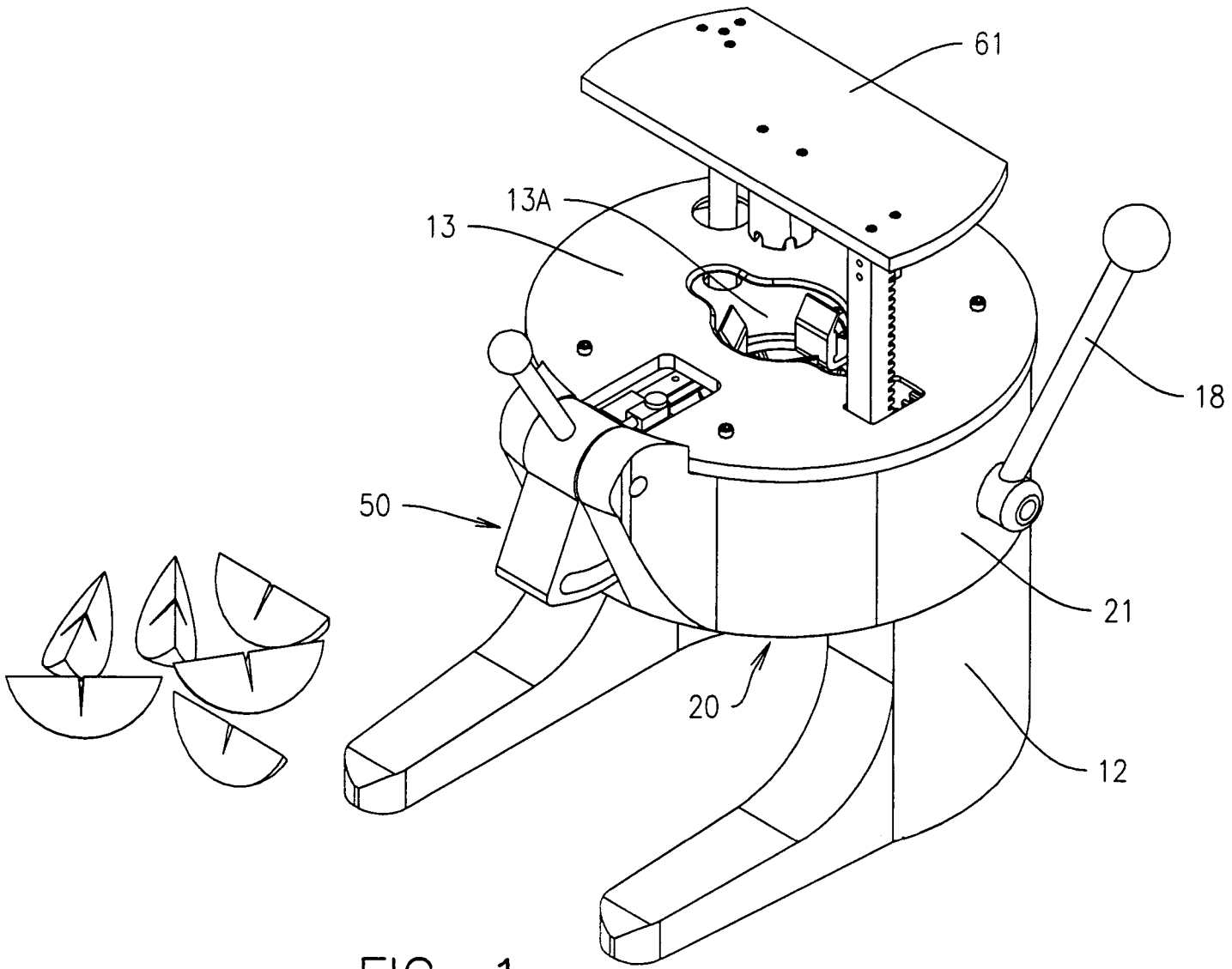
FIG. 1 is an isometric view of the present invention.

FIG. 1 illustrates the present invention. This invention mainly comprising the cutter base 12, the body assembly 20, including the outer body 21 upon which body cover 13 is attached, said body cover having an open center 13A for passing the citrus fruits through and other cutouts for the movement of mechanical parts, the wedge-cutting handle 18, that is assembled on a gear shaft, extends outside of outer body 21 on the right-hand side, the cam mechanism 50 with its two-dimensional cam pivotally assembled on a camshaft is mounted on the front noses of outer body 21 for cutting the crosscut on wedges, and the lemon drive plate 61 located on the top of the cutting machine with a rack, a press cylinder, and a guide rod mounted on it to drive and cut a lemon into wedges.

Figure 2:
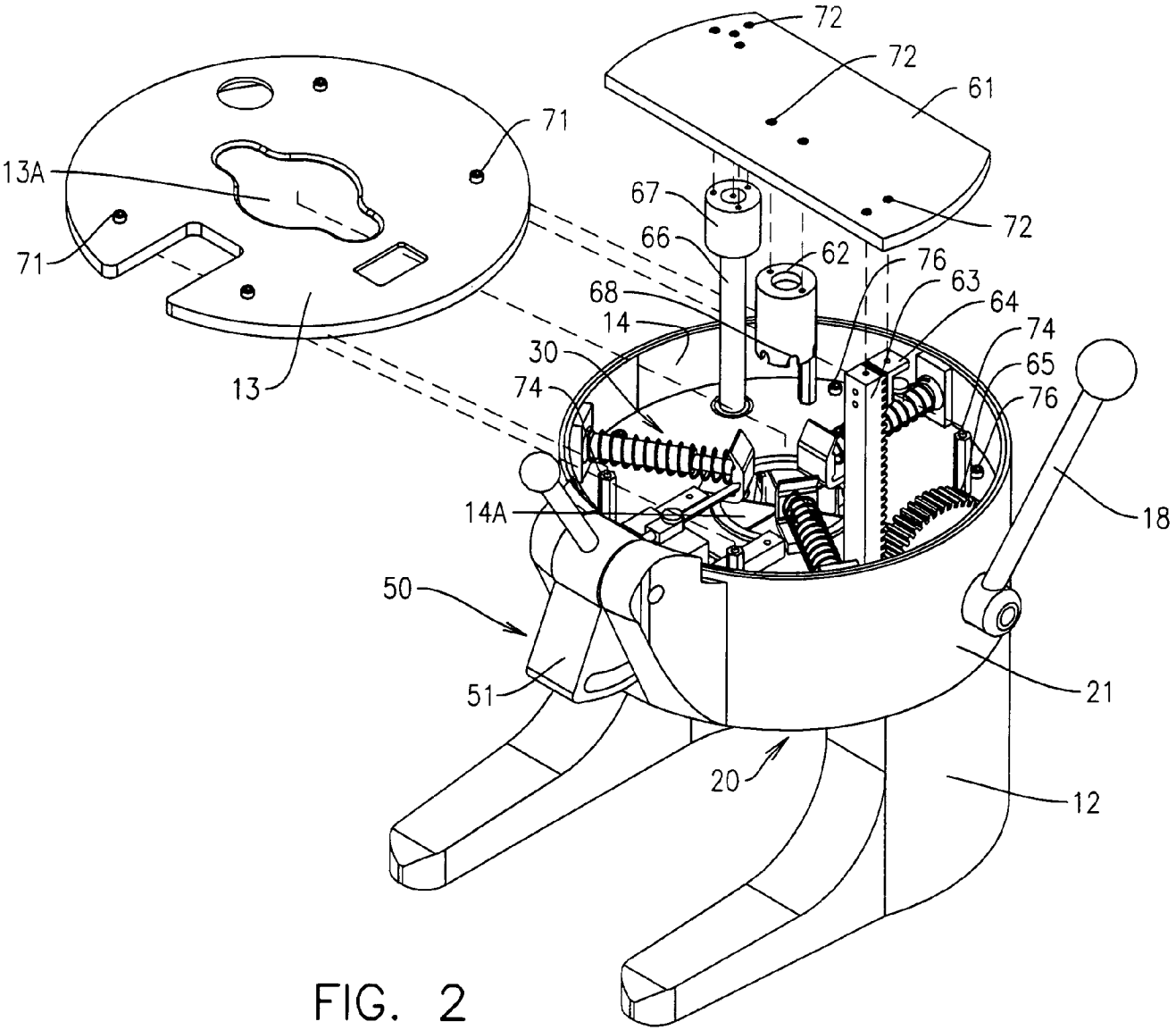
FIG. 2 is an isometric view of the present invention with the drive plate and body cover off the cutter.

FIG. 2 illustrates the detail assembly of the present invention. With the body cover 13 and the attached mounting screws 71 removed to side and the lemon drive plate 61 lifted up, exposes the inner-body 14, having standoffs 74 for mounting cover 13. The inner-body is nested inside of the outer body 21 and tied by screws 76. Rack 63, spur gear 65, and guide rod 66 penetrate the bottom of inner body through the cutouts on it. Rack 63 is fastened with angle 64 and guide rod 66 is embodied by rod ring 67 to stiffen the assembly on the lemon drive plate 61 with screws 72, while the press cylinder 62, having grooves 68 on its lower surface for wedge knife relieve, is directly mounted on plate 61 by screws 72. The three spring loaded auto-center units 30, which are equally-spaced assembled around the center hole 14A of the inner body 14, provide alignment of a loaded lemon with the machine center to be cut into equally-sized wedges. The cam mechanism 50, which, with its two-dimensional cam 51 pivotally mounted on the outer body 21, is partially assembled in the inner-body 21 shown on the drawing.

Figure 3:
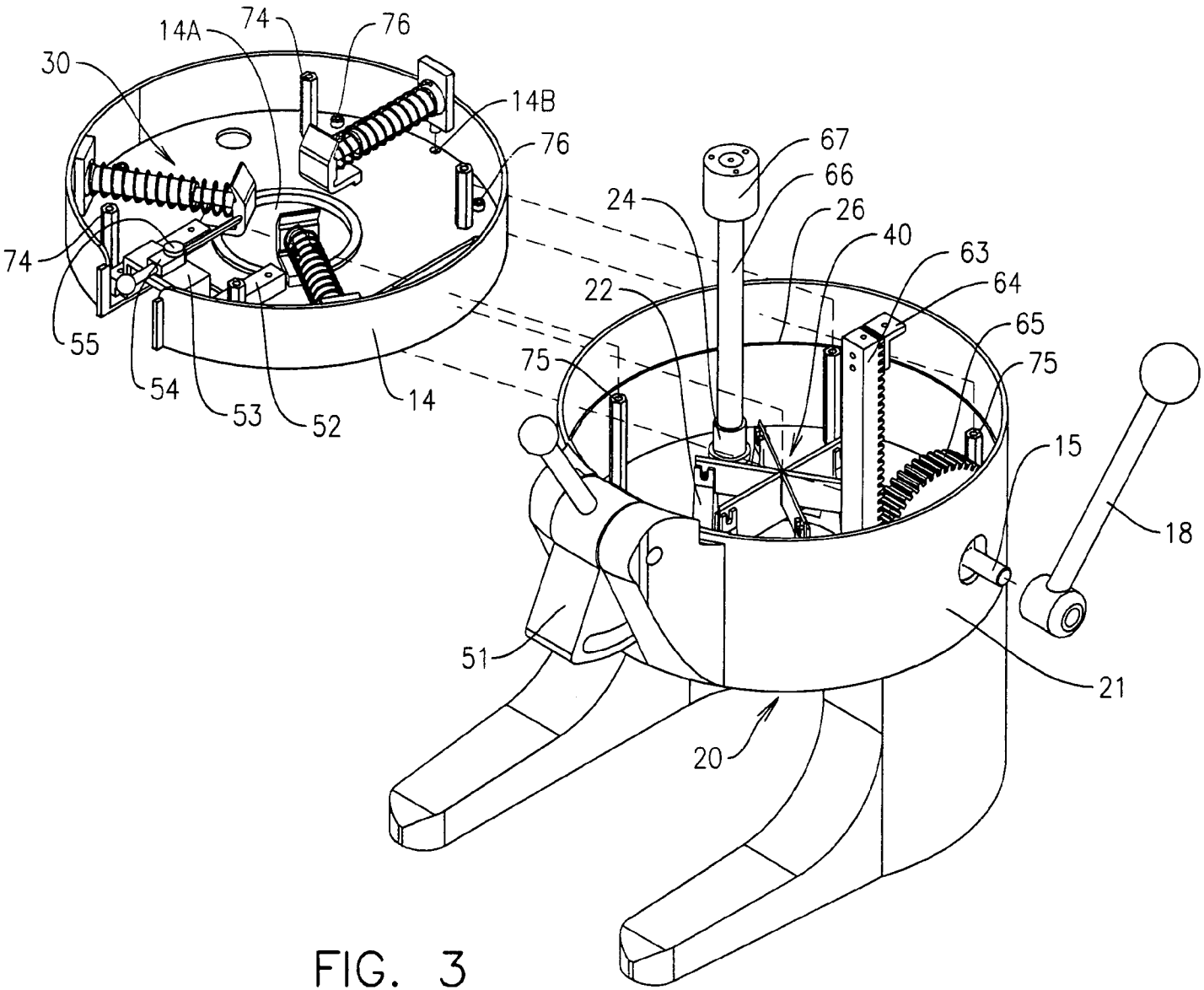
FIG. 3 is an isometric view of the present invention with the inner-body removed from the outer body of the cutter.

FIG. 3 illustrates the details of body assembly 20, including the details of the inner-body assembly, which is removed from the outer body 21 by screws 76 from standoffs 75 on the drawing, and the details of outer body assembly, with the wedge-cutting handle 18 removed from the gear shaft 15. In the inner body assembly, one of the three spring loaded auto-center units 30, being equally-spaced around the center hole 14A of the inner body 14, is lifted up for exposing hole 14B on the bottom edge of inner body 14 for the unit locating. The crosscut knife 54, located near the front cutout of inner body 14, is pivotally assembled on the slider 53, through a shoulder screw 55, driven by the two-dimensional cam 51 to move back/forth and wave horizontally at its forward position on slider 53 that travels back and forward between the two linear guides 52 on the bottom surface of inner body 14. In the outer body assembly, the wedge knife 40 is mounted on the knife frame 22 and the spur gear 65 is mounted on the gear shaft 15 that has one end extending out of the outer body 21 for mounting the wedge cut handle 18. Bushing 24, located on the bottom of the outer body, controls the vertical motion of the guide rod 66.

Figure 4:
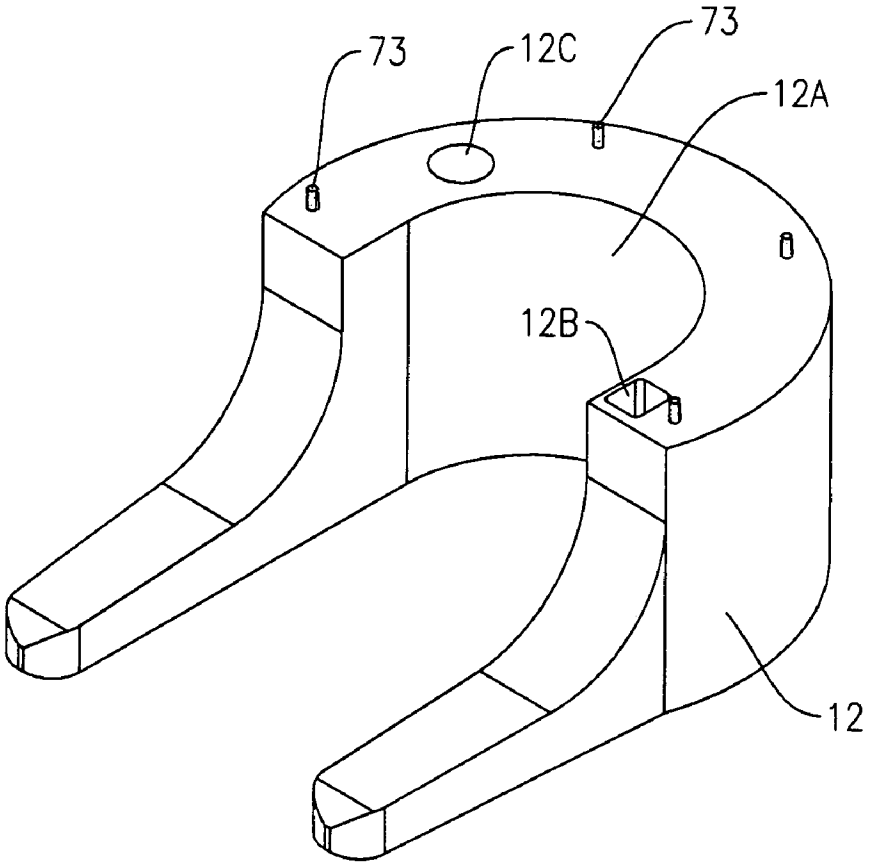
FIG. 4 is an isometric view of the cutter base.

FIG. 4 illustrates the horseshoe shaped cutter base 12. The open space 12A of the cutter base 12 allows cut lemon wedges to drop and to be removed. Screws 73 on the top surface of the base 12 are used to assemble the outer body 21 to the base 12 as illustrated in FIG. 3. The prism cavity 12B and cylinder cavity 12C of base 12 are used to permit the movement of rack 63 and guide rod 66.

Figure 5:
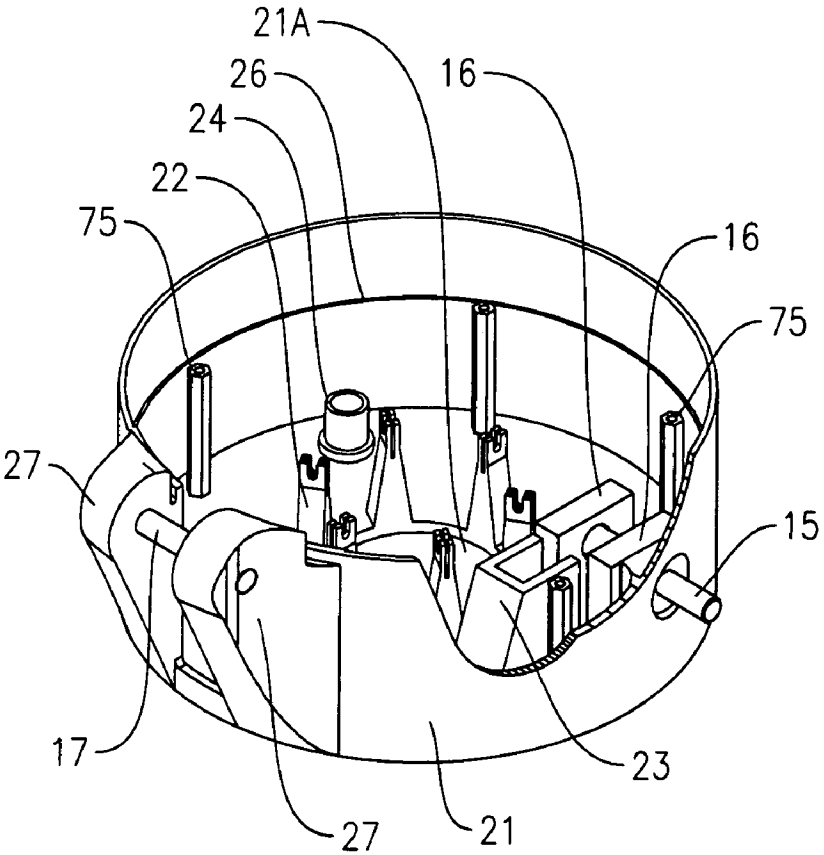
FIG. 5 is an isometric view of the outer body and the related parts.

FIG. 5 illustrates the detail construction of the outer body 21 with a cut-away wall near the gear shaft 15. The outer body 21 is preferably configured to have integrally molded wedge knife mounting frame 22 around the center hole 21A, and to have molded rack support channel 23 on the right-hand side and guide-rod bushing 24 on the left-hand side. With two of the gear housing blocks 16 mounted on the right-hand side bottom surface of the outer body 21, the gear shaft 15 extends from the right-hand of the two housing blocks 16 to outside through the side hole of the outer body 21. Two separated noses 27, preferably molded in front of the outer body, hold the camshaft 17, and the molded step 26 around the inside wall of outer body 21 is used for sitting the inner body 14 upon as illustrated in FIG. 2. The lower ends of standoffs 75 mount the outer body 21 on base 12 by the screws 73 as illustrated in FIG. 4.

Figure 6A:
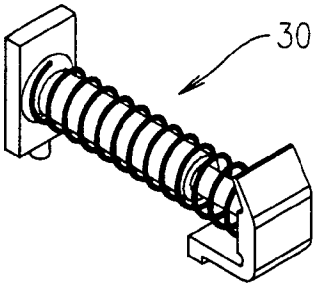
FIG. 6A is an isometric view of one of the three assembled auto-center units.
Figure 6B:
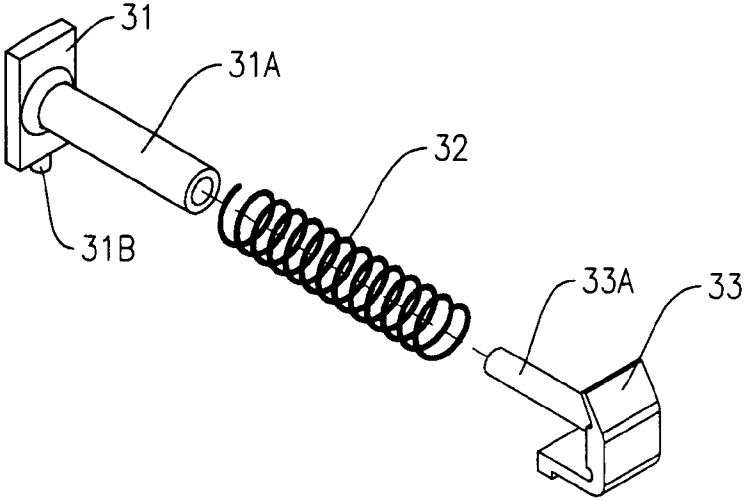
FIG. 6B is an exploded view of FIG. 6A.

FIGS. 6A through 6B illustrate the assembly and the exploded views of one of the three auto-center units 30 of the present invention. With a compression spring 32 assembled between the tube bracket 31 and the center adjuster 33, this auto-center unit allows the center adjuster 33 to stretch/shrink its pin 33A in the tube 31A of bracket 31 to automatically adjust the center of a loaded lemon aligned with the center of the cutter before being cut. The short pin 31B molded on the bottom surface of tube bracket 31 fits assembly unit 30 into hole 18 on the inner-body 14 as illustrated in FIG. 3.

Figure 7A:
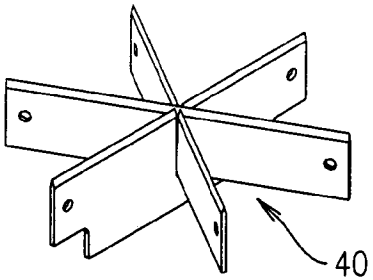
FIG. 7A is an isometric view of the wedge knife assembly.
Figure 7B:
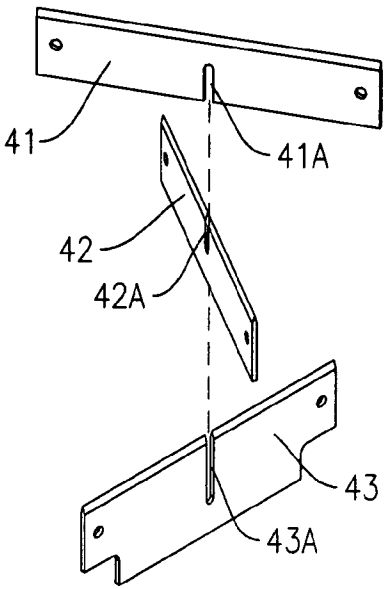
FIG. 7B is an exploded view of FIG. 7A.

FIGS. 7A through 7B illustrate the assembly and the exploded views of the wedge-cut knife of the present invention. A three-blade assembly is preferably configured to divide a loaded lemon into six wedges, and the blades 41, 42, and 43 are held one to another through the center slots 41A, 42A, and 43A on the blades, respectively, before being mounted on the knife frame 22 as shown in FIG. 3.

Figure 8B:
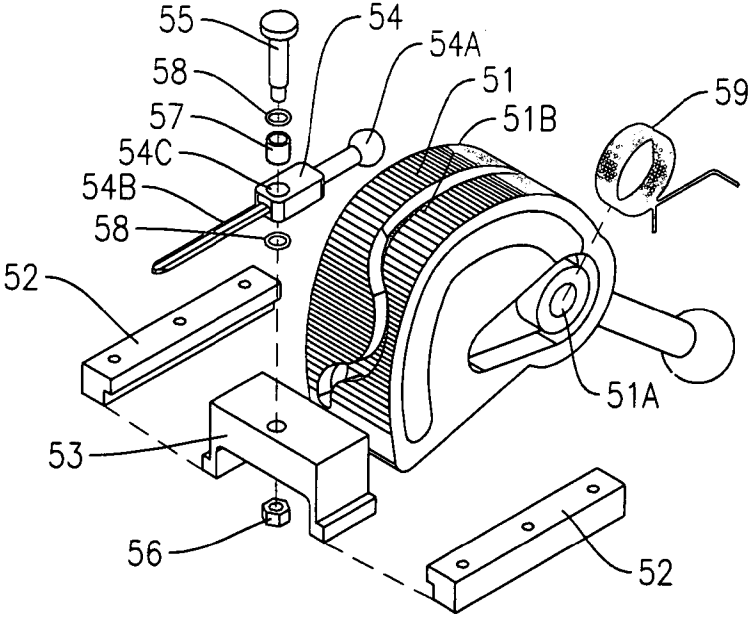
FIG. 8B is an exploded view of FIG. 8A and with cam 51 clockwise-rotated 90°.
Figure 8A:
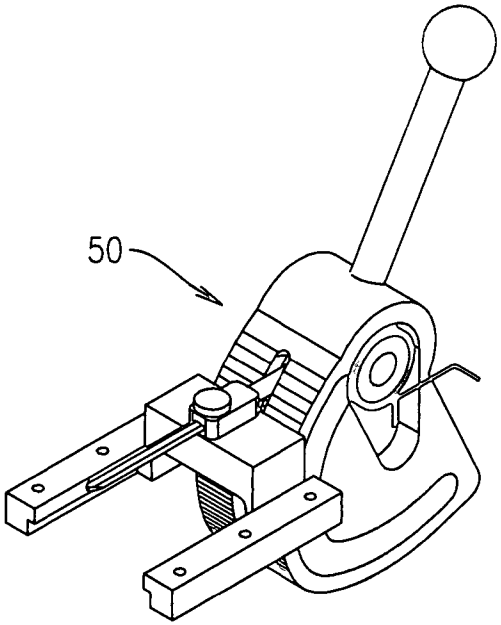
FIG. 8A is an isometric view of the two-dimensional cam mechanism assembly.

FIGS. 8A through 8B illustrate the cam mechanism 50 of the present invention. Such invention is preferably configured to have a two-dimensional cam 51, which is pivotally assembled through the cam center bore 51A on camshaft 17 in front of the outer body shown in FIG. 5, and also preferably to have a crosscut knife 54, which, with a ball 54A on one side and a knife 54B on the other side, to be driven with the ball 54A assembled as a follower in the curve-slot 51B of cam 51. The crosscut knife 54, having a through hole 54C in the middle, is pivotally mounted on the slider 53 by a shoulder screw 55 and a hex nut 56 with bushing 57 and flat washers 58. Driven by cam 51, knife 54 moves forward with slider 53 guided by the linear guides 52 to penetrate a loaded lemon skin over the center, and then waves the blade horizontally around to the shoulder screw 55 to make a crosscut inside of the lemon. A cam-return torsion spring 59 is assembled around the camshaft bore.

Figure 8C:
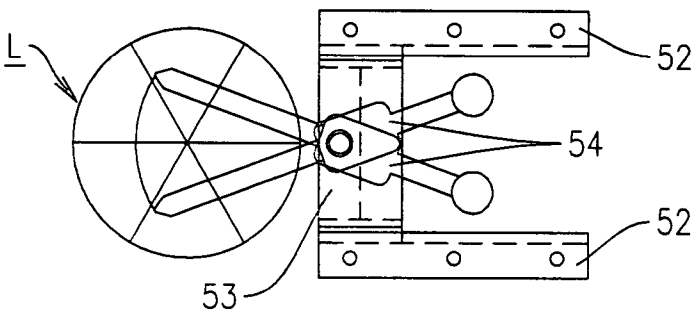
FIG. 8C is a top view of the cam mechanism assembly without the cam in accordance with an imagined lemon and the cross cutting knife waving range.

FIG. 8C illustrates a top view of the waving range of the crosscut knife 54 in a lemon L when the slider 53 reaches its forward end position guided by the linear guides 52.

Figure 9:
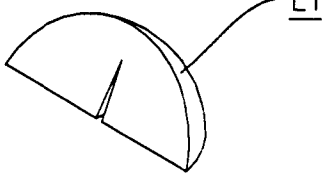
FIG. 9 is an isometric view of a typical lemon-wedge cut by the present invention.

FIG. 9 illustrates a typical lemon wedge L1 with a crosscut on it, the completed process of the present invention.

FIGS. 10A through 10D illustrate the details of the two-dimensional cam 51 of the present invention. Such invention cam is preferably configured to have a cam center bore 51A and a two-dimensional curve slot 51B, which is the track for the ball follower 54A of the crosscut knife 54 shown in FIG. 8B. The curve slot 51B is formed by cam 51 and the two inlaid curve brackets 51C and 51D, each locked with the cam by two press-fit pins 81, respectively. The narrow curve slot 51E, having the same curve track as curve slot 51B, is for retrieving the crosscut knife. The housing 51F of cam 51 is used to house spring 59 in FIG. 8B, while hole 51G is used allow crosscut knife assembly and will be sealed after the knife is assembled.

Figure 10E:
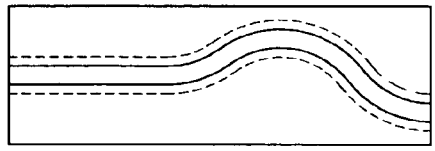
FIG. 10E is a spread out X-dimension curve of the two-dimensional cam of FIGS. 10A through 10C.
Figure 10A:
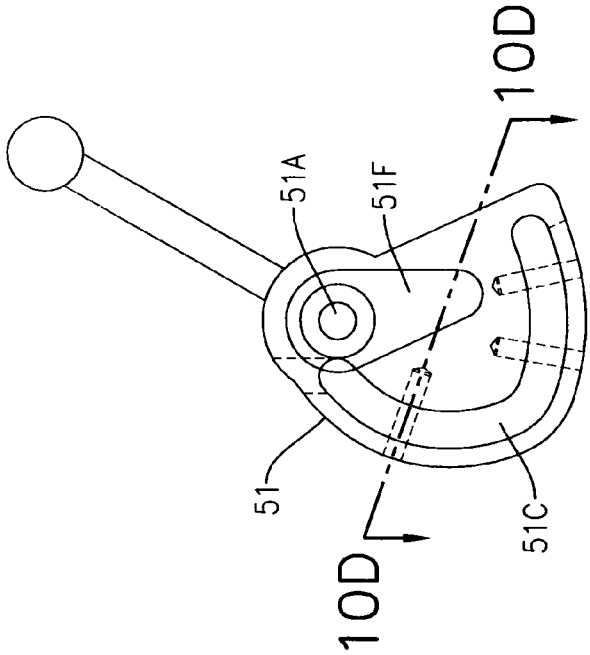
FIG. 10A is a front plan view of the two-dimensional cam with handle.
Figure 10C:
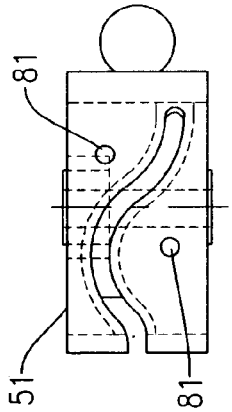
FIG. 10C is a bottom plan view of FIG. 10A.
Figure 10B:
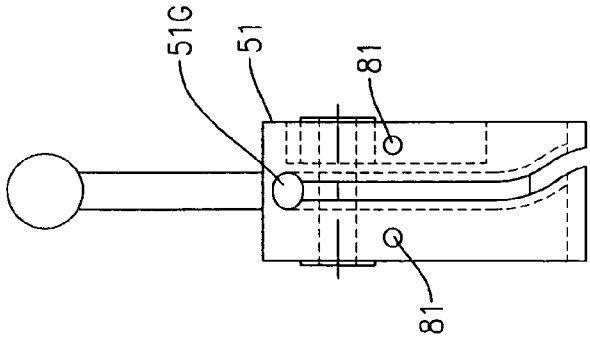
FIG. 10B is a left-side plan view of FIG. 10A.
Figure 10D:
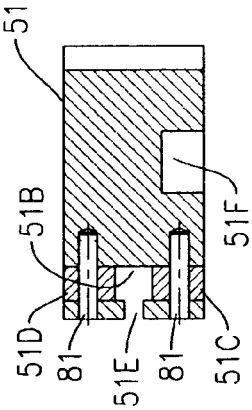
FIG. 10D is a section view taken along line 10D—10D of FIG. 10A.

FIG. 10E illustrates a spread out X-dimensional curve of the two-dimensional cam of FIGS. 10A through 10C.

Figure 11A:
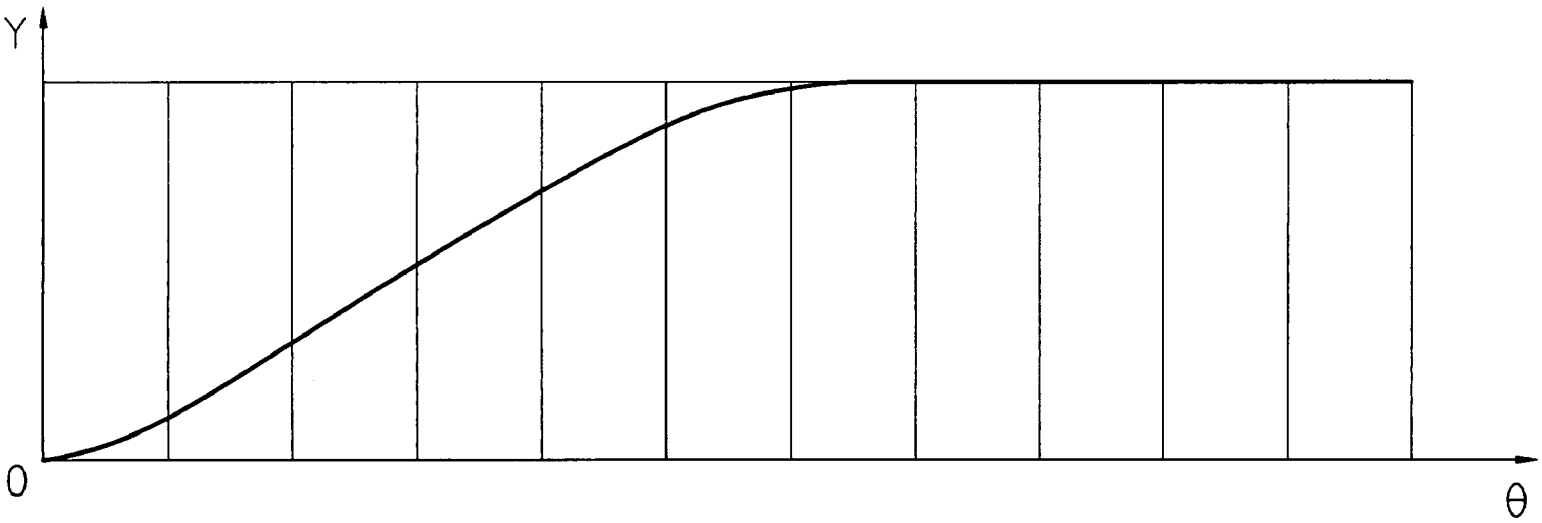
FIG. 11A is a Y-dimension displacement diagram of the two-dimensional cam of FIGS. 10A through 10C.

FIG. 11A illustrates a Y-dimension displacement diagram of the two-dimensional cam where the abscissa represents the cam input motion θ and the ordinate represents the follower travel distance Y in one cycle.

Figure 11B:
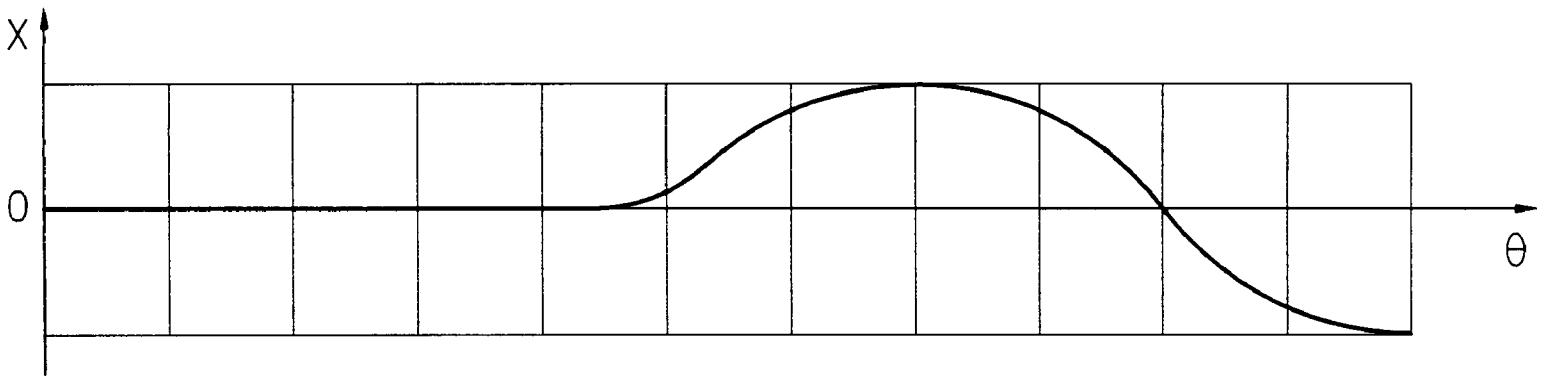
FIG. 11B is an X-dimension displacement diagram of the two-dimensional cam of FIGS. 10A through 10C.

FIG. 11B illustrates an X-dimension displacement diagram of the two-dimensional cam where the abscissa represents the cam input motion θ and the ordinate represents the follower travel distance X in one cycle.

The invention claimed is:

1. A citrus wedge cutting devise, and comprising:

a support base having vertical walls around the sides of an open space with a minimum of two and one-half inches between said walls to support manual operating pressure on a flat surface;

a housing assembly having a vertical through hole of two and one-half inch minimum diameter for moving citrus fruits through, being mounted on said support base;

a cover having an open space of two and one-half inch minimum diameter for moving citrus fruits through, being mounted on a top of said housing assembly; and a drive plate having a press device above said cover and engaged with said housing assembly by gear-rack and guide rod devices to move vertically;

whereby, when said drive plate is moved down, said press device contacts the loaded citrus fruit and presses it through said housing assembly to be cut into wedges said housing assembly includes a wedge knife assembled by multi-blades where each blade has a slot to combine one to another to form a wedge knife assembly, said housing assembly further including an extendable knife, said knife having a follower sitting in a curved slot of a cam such that the knife cuts slits in the wedges.

2. The citrus wedge cutting devise of claim 1 wherein said follower is a ball-end follower such that the ball part of said ball-end follower always contacts and is driven by said curved slot of said cam.

3. The citrus wedge cutting devise of claim 2 wherein said cam has a center bore and said curve slot such that the curve slot path has various curvatures related to said center bore on either dimensions, and the width of said curve slot is slightly larger than the size of said ball part in order to accommodate it.

4. The citrus wedge cutting devise of claim 2 wherein assembles said body on a" has been changed to said extendable knife is pivotally mounted on slider that travels according to a linear guide.

5. The citrus wedge cutting devise of claim 2 wherein said housing assembly further includes an inner housing assembly having a hole of two and one-half inch minimum diameter for moving citrus fruits through, being nested inside of said outer housing but above said wedge knife.

6. The citrus wedge cutting devise claim 5 wherein said inner housing assembly including an auto-center device having a least three adjustable units distributed around said hole, and each said adjustable unit having shaft and tube mating parts uses spring force to adjust the alignment of the center of a loaded citrus fruit automatically before the cutting action.

7. The citrus wedge cutting devise of claim 1 further includes a manually operated handle assembled on said machine body to transfer man power through said gear-rack device to control the movement of said drive plate.

* * * * *